US006081483A

United States Patent [19]

Capt et al.

[11] Patent Number: 6,081,483

[45] Date of Patent: Jun. 27, 2000

[54] DATE MECHANISM FOR CLOCKWORK MOVEMENT

[75] Inventors: Edmond Capt; Alain Zaugg, both of Le Brassus, Switzerland

[73] Assignee: Frederic Piguet S.A., Le Brassus, Switzerland

[21] Appl. No.: 09/259,256

[22] Filed: Mar. 1, 1999

[30] Foreign Application Priority Data

Mar. 5, 1998 [EP] European Pat. Off. ..... 98103900

[51] Int. Cl.[7] ..... G04B 19/24

[52] U.S. Cl. ..... 368/28; 368/37

[58] Field of Search ..... 368/28, 34–38

[56] References Cited

U.S. PATENT DOCUMENTS 4,320,476 3/1982 Berney ..... 368/28

FOREIGN PATENT DOCUMENTS 29 25 278 1/1980 Germany .
196 49 590 10/1997 Germany .
324270 9/1957 Switzerland .
342270 12/1959 Switzerland .

*Primary Examiner*—Vit Miska
*Attorney, Agent, or Firm*—Griffin & Szipl, P.C.

[57] ABSTRACT

A date movement for a clockwork movement including a member (8) for indicating the tens having four positions carrying a scale from <<zero>> to <<three>> or from <<one>> to <<three>> plus a blank, provided for effecting one step every ten days, and a member (10) for indicating the units arranged for effecting one step per day, characterised in that the units indicator member (10) can occupy thirty one positions and carries three successive scales from <<zero>> to <<nine>>, one of the three scales, called the modified scale, having an additional <<one>> inserted between its <<zero>> and its <<one>>.

8 Claims, 3 Drawing Sheets

DATE MECHANISM FOR CLOCKWORK MOVEMENT

The present invention concerns a date mechanism for a clockwork movement and more particularly a mechanism of this type allowing the display of date figures of large dimensions.

Wristwatches including a conventional date display mechanism where the date figures are displayed, through an aperture or window made in a dial, have the drawback of being difficult to read because of the small size of the windows and the figures transferred on the indicator members visible through such windows.

A date indicator mechanism displaying date figures of large dimensions for a calendar watch including an intermediate wheel effecting two revolutions per day and all of whose teeth are truncated except one is known from Swiss Patent No. CH 342 270. The non-truncated tooth acts on a toothed ring having twenty teeth which carries the figures of the date units and which is visible through a large window. Each of these figures is repeated twice in a row on the wheel. Thus any units figure which appears at midnight in the window is replaced at midday, on the second revolution of the intermediate wheel, by a second identical figure which will only disappear at the following midnight to allow the following units figure to appear. The ring further includes an additional tooth which, during the passage from the second <<zero>> to the first <<one>> of the units, drives by one step a star-wheel having four branches carrying the figures for the tens of the date, i.e. the figures <<zero>>, <<one>>, <<two>> and <<three>>.

With this mechanism, it is however necessary to act on the units ring and on the star-wheel for the tens at the end of the month to be able to pass respectively from the twenty-eighth, twenty-ninth and thirty first day of the end of the month to the first day of the following month. This thus requires the use of a complex correction mechanism which has, in particular, to allow the movement of the tens star-wheel by one step without any accompanying movement of the units ring. Such mechanisms generally require the use of disconnecting-gear devices for the units ring which complicates the making of such mechanisms and thus makes them more expensive and voluminous.

The main object of the present invention is to overcome the drawbacks of the aforementioned prior art by providing a date display mechanism allowing date figures of large dimensions to be displayed which is thus easier to read, such mechanism requiring only extremely simple means and few manufacturing modifications to the basic movement in which it is integrated.

The invention therefore concerns a date mechanism for a clockwork movement including a member for indicating the tens with four positions carrying a scale from <<zero>> to <<three>> or from <<one>> to <<three>> plus a blank, arranged for effecting at least one step every ten days, and a member for indicating the units arranged for effecting a step every twenty-four hours, characterised in that the units indicator member can occupy thirty one positions and carries three successive scales from <<zero>> to <<nine>>, one of the three scales having an additional <<one>> inserted between its <<zero>> and its <<one>>.

As a result of these features, the date mechanism according to the invention, on the one hand, allows date figures of large dimensions to be displayed and, on the other hand, allows the passage from the end of one month of thirty one days to the first day of the next month without acting on a correction mechanism. In the case of a month less than thirty one days, the passage from the end of one month to the first day of the next month is performed by using a conventional date correction mechanism.

According to an advantageous feature of the invention the units indicator member is associated with a first toothing of thirty one teeth which co-operates with a driving member, and with a second toothing including four teeth, three of whose teeth drive the tens indicator member during the passage from <<zero>> of one scale of the units indicator member to the <<one>> of the following scale, while the fourth tooth drives the tens indicator member during the passage from the additional <<one>> of the modified scale to the following <<one>>.

According to a preferred embodiment, the units indicator member is formed of an annular disc and the first and second toothings are inner toothings which extend in two different planes.

Other features and advantages of the present invention will appear in the following description of a preferred embodiment, given by way of non-limiting example with reference to the annexed drawings, in which.

Figure 1:
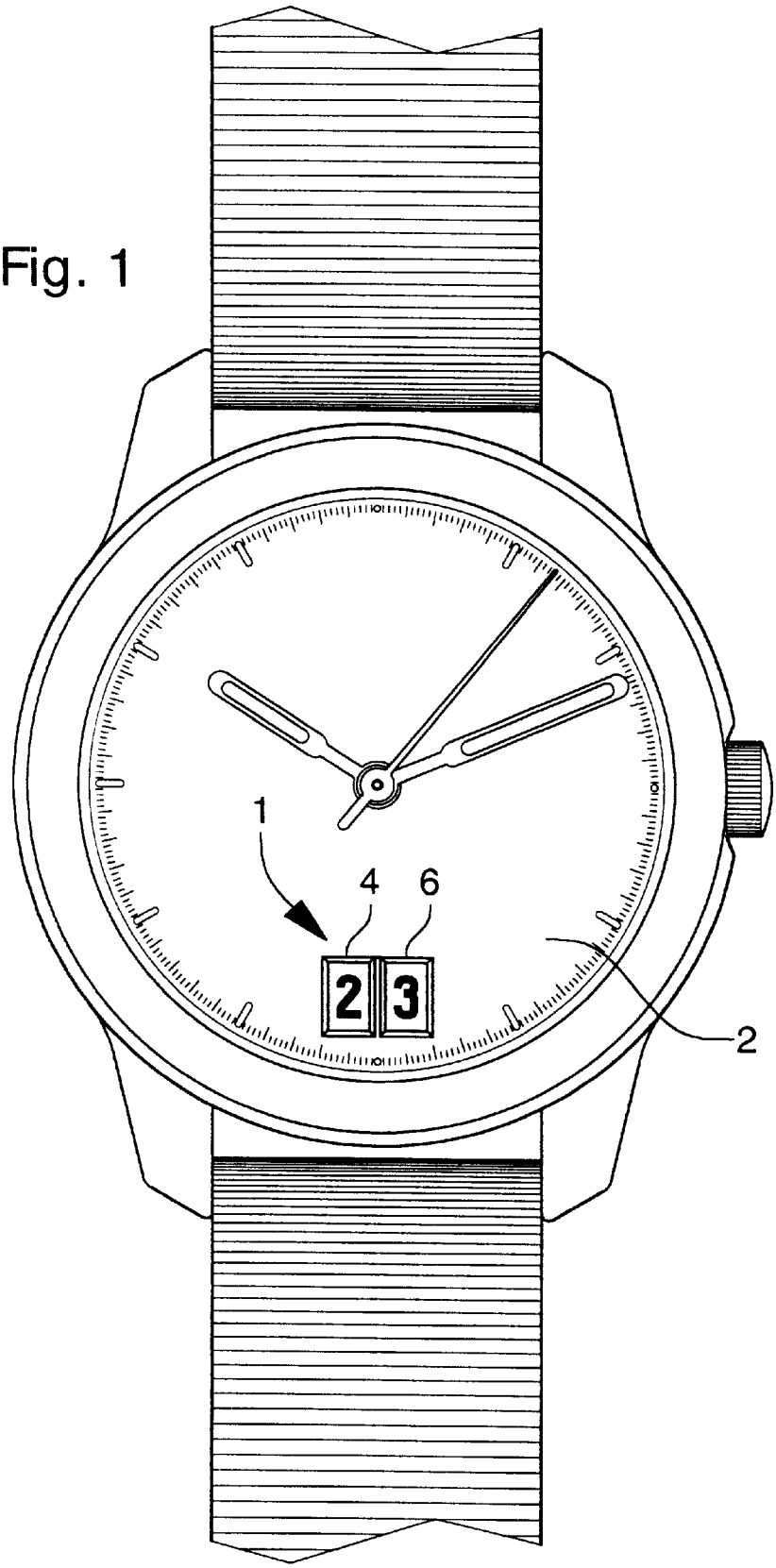
FIG. 1 is a plane view of a watch fitted with a date mechanism according to the invention.

The watch shown schematically in FIG. 1 includes a date mechanism designated by the general numerical reference 1. The watch also includes other mechanisms arid indicator members. These will not however be described here since they are known to those skilled in the art and they do not directly concern the date mechanism according to the present invention.

FIG. 1 also shows that the watch fitted with date mechanism 1 according to the invention includes a dial 2 provided with two windows 4, 6 juxtaposed at six o'clock which in another embodiment could be merged into a single large window. Window 4 allows a figure relating to the tens of a date to appear, while window 6 allows a figure relating to the units of a date to appear so as to permit, according to their relative positions, the indication of the figures from <<one>> to <<thirty one>>.

Figure 2:
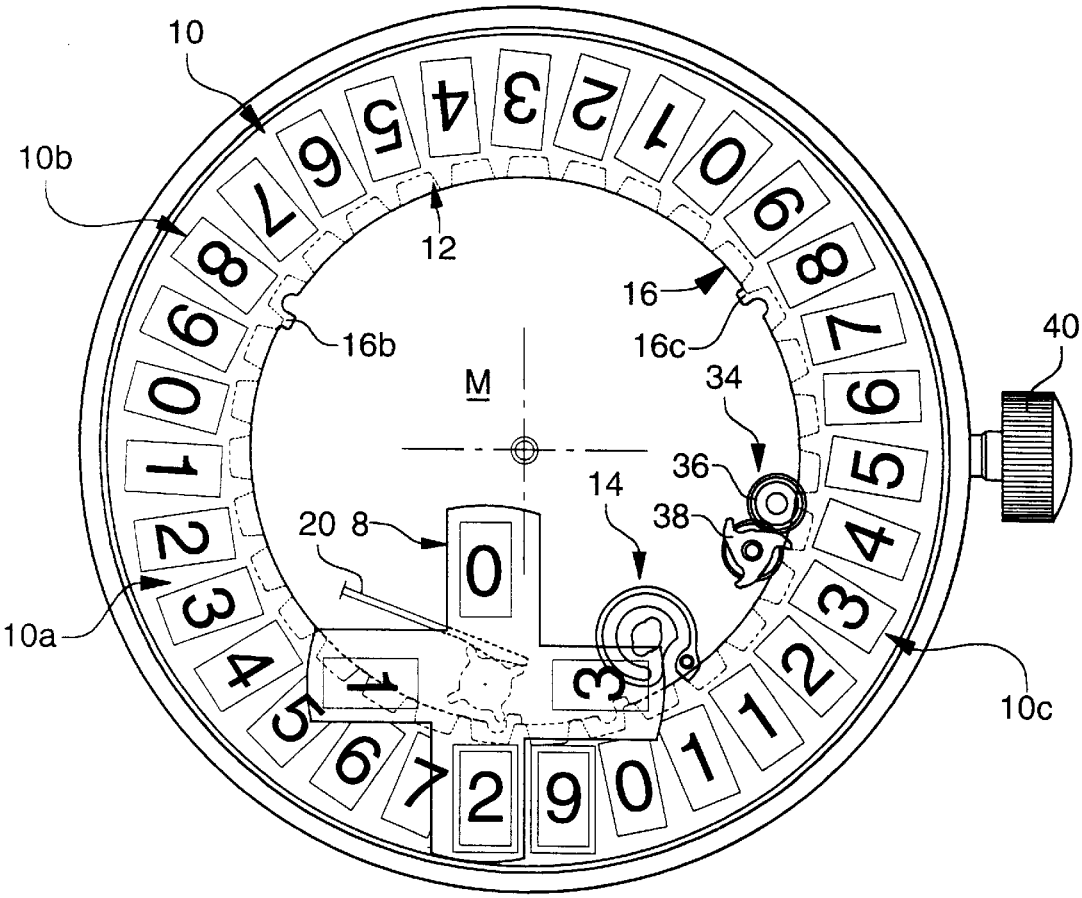
FIG. 2 is a plane view of the date mechanism according to the invention.

As is visible in FIG. 2, these figures are carried by two different indicator members 8 and 10, respectively tens indicator member 8 and units indicator member 10. The display of dates, i.e. the day of the month, via these two members 8 and 10 thus allows the respective dimensions of the figures carried by each of these members 8 and 10 to be increased and to make reading of the dates easier.

Tens indicator member 8 carries a scale from <<zero>> to <<three>> or from <<one>> to <<three>> plus a blank, and it is arranged for effecting a step every ten days. Units indicator member 10 carries three successive scales 10*a*, 10*b* and 10*c* from <<zero>> to <<nine>>, scale 10*c*, called the modified scale, having an additional <<one>> inserted between its <<zero>> and its <<one>>. Indicator member 8 can occupy four different positions, while indicator member 10 can occupy thirty one different positions.

Figure 3:
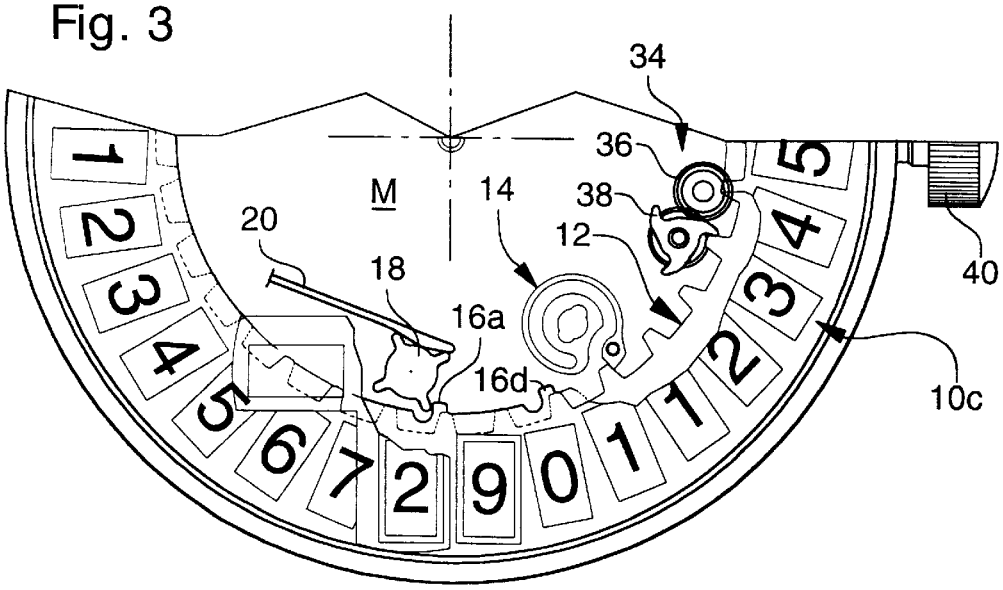
FIG. 3 is a halt plane view wherein the tens indicator member and the units indicator member have been partially cut away.
Figure 4:
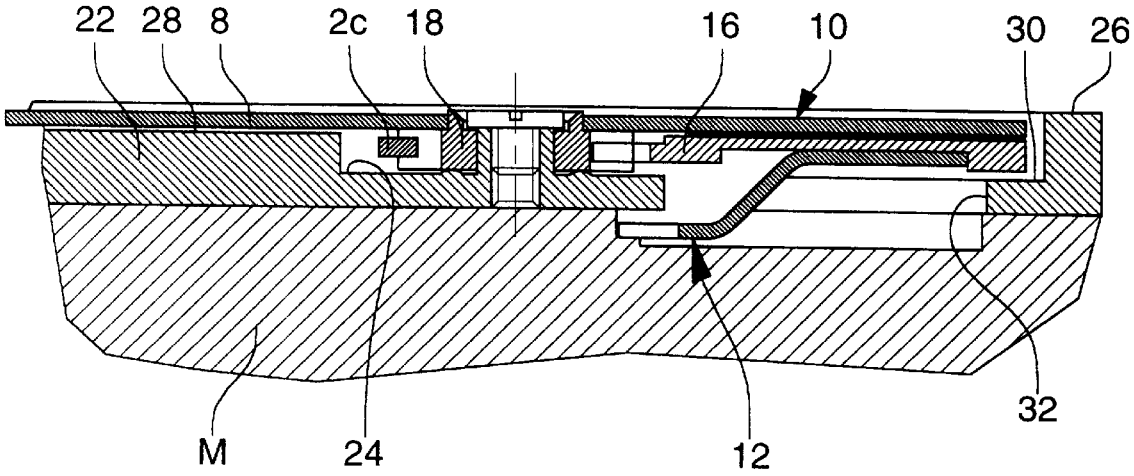
FIG. 4 is a partial cross-section along the line III—III of FIG. 2 of the date mechanism according to the invention.

With reference to FIGS. 2 to 4, it is seen that units indicator member 10 is formed of an annular disc associated with a first inner toothing 12 including thirty one teeth. A driving member 14 having the shape of a driving finger-piece and belonging to a basic movement M conventionally effects one revolution every twenty-four hours, driving annular disc 10 in a conventional manner via action on toothing 12. A jumper-spring (not shown) attached to basic movement M acts on toothing 12 to keep annular disc 10 in place when it is not being driven. Units indicator member 10 is also associated with a second inner toothing 16 including four teeth 16*a*, 16*b*, 16*c* and 16*d*. These teeth are distributed on the inner periphery of annular disc 10 so that they drive tens indicator member 8 during the respective passage from <<zero>> of scales 10*a*. 10*b* and 10*c* of units indicator member 10 to the <<one>> of the following scale. The fourth tooth 16*d* drives tens indicator member 8 during the passage from the additional <<one>> of modified scale 10*c* to the following <<one>> of this same scale.

With reference more particularly to FIG. 4, it is seen that toothings 12 and 16 extend in two different planes, toothing 16 co-operating with a star-wheel 18 with four teeth attached to tens indicator member 8, star-wheel 8 being positioned by a jumper-spring 20.

In the example illustrated, tens indicator member 8 moves above annular disc 10 and includes blanks which allow the units figure which is carried by said annular disc 10 and which has to be displayed through window 6, to appear. Preferably, tens indicator member 8 is formed of a blanked disc in the shape of a cross with four branches, the branches respectively carrying the figures <<zero>>, <<one>>, <<two>> and <<three>> as is illustrated, or <<one>>, <<two>>, <<three>> and a blank.

The mechanism according to the invention further includes a support-plate 22 for star-wheel 18, tens cross 8 and annular units disc 10. This plate 22 is disposed at the surface of basic movement M with which the date mechanism according to the invention is associated. More precisely, star-wheel 18 is rotatably mounted in a recess 24 made in the upper surface 26 of plate 22, the tens cross 8, attached to star-wheel 18, extending into a second recess 28 which is also made in surface 26 and is situated between this surface and the bottom of recess 24. Plate 22 also includes, machined into surface 26 thereof, an annular path 30 along which units indicator member 10 moves. This annular path 30 includes a recess 32 into which inner toothing 12 extends to co-operate with driving finger-piece 14.

The operation of the date mechanism according to the present invention will now be described. Driving finger-piece 14 acts once every twenty-four hours on toothing 12 to cause annular disc 10 to advance by a thirty first of a revolution. Thus, any units figure of the date which appears, for example, at midnight in window 6, will be replaced during the passage to the following midnight by the figure which follows.

On the <<tenth>>, <<twentieth>> and <<thirtieth>> of the month, driving finger-piece 14 acts on toothing 12, as described hereinbefore, to cause the <<nine>> of the corresponding units scale to pass to the <<zero>> of the following scale, teeth 16*a*, 16*b* and 16*c* of toothing 16 acting on star-wheel 18 to cause the tens figure to pass simultaneously from <<zero>> to <<one>>, from <<one>> to <<two>> and from <<two>> to <<three>> respectively.

It will be noted in this regard that in the embodiment illustrated, teeth 16*a*, 16*b* and 16*c* are disposed respectively substantially facing the <<eight>> figures of scales 10*a*, 10*b* and 10*c*.

During the passage from <<thirty>> to <<thirty one>>, driving finger-piece 14 acts normally on toothing 12, as described hereinbefore, and causes the <<zero>> of units scale 10*b* to pass to the first <<one>> of units scale 10*c*, none of the teeth of toothing 16 acting at this moment on star-wheel 18, so that cross 10 remains immobile and still displays the <<three>> of the tens.

During the passage from the <<thirty one>> of one month to the <<one>> of the following month driving finger-piece 14 acts normally on toothing 12, as described hereinbefore, and causes the first <<one>> of units scale 10*c* to the second <<one>> of this same scale. Simultaneously, tooth 16*d* of toothing 16 acts on star-wheel 18 to cause the figure <<three>> carries by tens indicator member 8 to <<zero>> or to a blank display surface.

It is thus understood that the date mechanism according to the invention is designed so that tens cross 8 effects one revolution per month in four steps, the same tooth of toothing 16 producing always the display of the same figure, while the annular disc effects one revolution every thirty one days.

In the case of a month of thirty one days, the passage from the last day of this month to the <<one>> of the following month can be effected using a known sliding pinion correction device 34 which acts directly on toothing 12 of annular disc 10. Device 34 includes in particular a wheel 36 meshed with a sliding pinion 38 having three teeth. In a first direction of rotation of correction stem 40 which is partially shown, wheel 36 drives pinion 38 which is guided in an oblong hole (not shown) to mesh with toothing 12 of annular disc 10. This latter is then moved clockwise by the number of steps necessary to allow the second <<one>> of scale 10*c* appear in window 6. In a conventional manner, pinion 38 is released from toothing 12 when stem 40 is actuated in the opposite rotational direction to the first direction. It will be noted that the date mechanism according to the invention can, without any major modification, use the date correction device of a conventional movement. The use of such a correction mechanism allows the passage from the end of a month of less than thirty one days to the first day of the following month to be assured manually in an easy and rapid manner.

Certain modifications may be made to the date mechanism which has just been described without thereby departing from the scope of this invention. Thus, for example, one could envisage moving the axis of rotation of tens cross 8 towards the centre of movement M so that it no longer moves above annular disc 10, but moves in juxtaposition thereto. In this case, window 4 would of course be disposed above window 6 on the 12 o'clock–6 o'clock axis.

What is claimed is:

1. A date movement for a clockwork movement (M) including a member for indicating the tens having four positions carrying a scale from <<zero>> to <<three>> or from <<one>> to <<three>> plus a blank, arranged for effecting at least one step every ten days, and a member for indicating the units arranged for effecting a step every twenty-four hours, wherein the units indicator member can occupy thirty one positions and carries three successive scales from <<zero>> to <<nine>>, one of the three scales, called the modified scale, having an additional <<one>> inserted between its <<zero>> and its <<one>>.

2. A date mechanism according to claim 1, wherein units indicator member is associated with a first toothing of thirty one teeth which co-operates with a driving member, and with a second toothing including four teeth, three of whose teeth drive the tens indicator member during the passage from <<zero>> of one scale of the units indicator member to the <<one>> of the following scale, while the fourth tooth drives the tens indicator member during the passage from the additional <<one>> of the modified scale to the following <<one>>.

3. A date mechanism according to claim 1, wherein the units indicator member is formed of an annular disc and wherein the first and second toothings are inner toothings which extend in two different planes.

4. A date mechanism according to claim 2, wherein the tens indicator member moves above the units indicator member and includes blanks allowing the units figures which need to be displayed to appear.

5. A date mechanism according to claim 4, wherein units indicator member is formed of a blanked disc in the shape of a cross associated with a star-wheel with four branches which co-operates with said second toothing.

6. A date mechanism according to claim 5, including a plate in which the disc and the star-wheel for the tens are rotatably mounted, said plate further including an annular path along which said units disc moves.

7. A date mechanism according to claim 6, wherein the annular path includes a recess into which the first inner toothing extends to co-operate with said driving member.

8. A date mechanism according to claim 7, wherein the first toothing extends below the level of said second toothing.

* * * * *